United States Patent [19]

Torick

[11] Patent Number: 4,516,257

[45] Date of Patent: May 7, 1985

[54] TRIPHONIC SOUND SYSTEM

[75] Inventor: Emil L. Torick, Darien, Conn.

[73] Assignee: CBS Inc., New York, N.Y.

[21] Appl. No.: 597,000

[22] Filed: Apr. 5, 1984

Related U.S. Application Data

[63] Continuation of Ser. No. 441,571, Nov. 15, 1982, abandoned.

[51] Int. Cl.[3] ..... H04H 5/00

[52] U.S. Cl. ..... 381/4; 381/27

[58] Field of Search ..... 381/1–4, 381/27; 358/143, 144, 198

[56] References Cited

U.S. PATENT DOCUMENTS 3,679,832 7/1972 Halpern ..... 179/15 BT
4,405,944 9/1983 Eilers et al. ..... 358/144

FOREIGN PATENT DOCUMENTS 75221 6/1977 Japan ..... 358/144
54000 4/1980 Japan ..... 358/144

*Primary Examiner*—Forester W. Isen
*Attorney, Agent, or Firm*—Spencer E. Olson

[57] ABSTRACT

A triphonic sound system in which three independent stereophonically related audio frequency source signals L, R and C are combined to derive three other audio frequency signals M, S, and T which respectively comprise (L+1.4C+R, (L−R) and (−1.4C). In a preferred transmitter embodiment, useful in television broadcasting, the audio signals S and T modulate two quadrature-related sub-carriers of the same frequency to develop two double-sideband, suppressed-carrier signals, the frequency of the subcarriers being sufficiently high as to assure a frequency gap between the lower sidebands of the modulated subcarrier signals and the audio frequency signal (L+1.4C+R). The aforementioned signals, and a pilot signal having a frequency which lies within the frequency gap, are combined and frequency-modulated onto a high frequency carrier for the purpose of transmitting the same to one or more remote receivers. The receiver is operative in response to reception of the high frequency carrier to reproduce each of the audio frequency source signals L, R and C, and includes means for reproducing conventional monophonic and two-channel stereophonic broadcasts. The described matrix equations are amenable to and useful with multi-channel television sound systems currently under consideration for future broadcast service in the United States.

17 Claims, 7 Drawing Figures

TRIPHONIC SOUND SYSTEM

BACKGROUND OF THE INVENTION

This application is a continuation of application Ser. No. 441,571, filed Nov. 15, 1982, now abandoned.

This invention relates to a triphonic sound transmission system that is particularly compatible with existing monophonic and biphonic receivers.

To accommodate the increasing public awareness and interest in home reproduction of multi-channel sound, the process of selecting a standard transmission system for stereophonic sound for television is currently underway. This activity, intially undertaken by the broadcast and consumer electronics industries, will eventually include the Federal Communications Commission (FCC) and the consumer marketplace, and, in turn, creates a need for improving multi-channel service, in particular, the provision of a triphonic sound system for television broadcasting.

Multi-channel sound transmission had its practical beginning with the experiments at Bell Laboratories in the early 1930's described by J. C. Steinberg and W. B. Snow in an article entitled "Symposium on Wire Transmission of Symphonic Music and its Reproduction in Auditory Perspective: Physical Factors" published in the *Bell System Technical Journal,* Vol. XIII, No. 2, April 1934. Following the work of the National Stereophonic Radio Committee established by the Electronics Industries Association in 1959, the present-day system for FM stereophonic radio broadcasting was authorized by the FCC in 1961. Further research in the past decade has led to the development of a number of proposed systems both for AM stereophonic broadcasting and FM surround-sound broadcasting.

Interest in multi-channel sound with visual images was given strong impetus by Walt Disney's pioneering movie "Fantasia", first released in 1940. Today the specification for 35 millimeter cinematic film provides for four tracks of audio recording, and the 70 millimeter standard provides for six. With such well-established precedents in the film industry, and the routine transmission of filmed programs by television broadcasters, consideration is now being given to methods for transmitting more than a single audio channel with a television picture. While it may be argued that the audio needs of the cinema and the television media are different, and, in particular, that the viewing screen size, aspect ratio, audience seating, transmission band width limitations, timeliness, and production costs seem to suggest the use of the simplest possible audio system for today's television, larger-screen home receivers are already gaining in popularity, and serious studies are underway toward the establishment of wide-screen high definition service, thereby creating the requirement to consider the audio needs in the near- and lonerterm future and to provide the technical means to meet such future needs.

Since any transmission system for sterophonic television sound must be compatible with existing service, all systems being considered begin with a monophonic sum signal (M) on the existing baseband channel, and a stereophonic difference signal (S) to enable separation of the monophonic signal into its left and right components at the home receiver. In the existing two-channel stereophonic system approved by the FCC, and also in those systems being considered for transmission of television stereophonic sound, a symmetrical matrix, expressed by the following equations, is employed:

$$M=(L+0.7C)+(0.7C+R)$$

$$S=(L-R)$$

In the home receiver, the signals applied to the left and right loudspeakers are derived by the addition and substraction (and normalization of gain) of these combined signals:

$$\text{Left Channel}=M+S=L+0.7C$$

$$\text{Right Channel}=M-S=R+0.7C$$

While it is generally not customary to show the center front term C in the matrix equation, it is included here to demonstrate some interesting properties important to multi-channel sound broadcasting with television. Regardless of how many special audio effects may be employed or how wide a viewing screen may be used, the important dialogue and other prominent audio signals conventionally have been, and undoubtedly will continue to be, placed at the center of the picture. For traditional two-channel loudspeaker playback, the center signal is presented as a virtual, or phantom, image created by the acoustic power summation of sound of equal amplitude and phase from each of the two loudspeakers. If the left, center, and right signals appeared at equal intensity in the original program, such balance will be maintained in the stereophonic home listening home environment. In the monophonic listening mode, however, the equal voltage components of the center signal in the left and right channels will add arithmetically, causing the sum signal to be presented as L+1.4C+R. This equation illustrates the well-known 3 dB center imbalance common to monophonic playback of all stereophonic systems which use traditional amplitude panning controls. Although an inevitable consequence of the matrix process, the result is a desirable increase in the prominance of the center channel, especially in presence of side stage effects. With two-channel reproduction, where the center image is at normal level, a listener can perform such discrimination easily, even in the presence of competing sounds.

That the important center signal is displayed as a phantom image is unfortunate in that while the image is reasonably well-defined for a listener rigidly positioned on the line of symmetry between the two loudspeakers, its location for other listener positions is vague and unstable. Any motion of the listener's head causes apparent changes. At best, image location will be vague; at worst, it will appear to move with the slightest motion of the head. While this appears not to significantly detract from the enjoyment of music alone, it presents a more serious problem when the sound is accompanied by visual images. Even for a listener positioned along the line of loudspeaker symmetry, the image will appear to rise as it is panned from left through center to right. Although this elevation of the center image has been recognized since first reported in 1959, the effect has not yet been adequately explained. However, the degree of elevation appears to be related to the angles subtended from the listener to the speakers, being least prominent when the angle is small, but settling overhead when the listener is directly between the loudspeakers.

Even with the significant body of localization theory that has been advanced in the last 20 years or so, and despite the fact that the traditional model requires careful seating of the listener, the traditional model still remains the only one in practical use. One reason may be that it permits the use of simple production techniques and relatively inexpensive equipment, but more importantly, is that different and far more complex panning functions would be required for each listener position and orientation in the listening room. Briefly summarizing psychoacoustics localization principles, the basic model of localization assumes that the geometry of the human head is symmetrical from left to right, and that the hearing acuity in the two ears is equal. Thus, a center image will be perceived when the outputs of the two loudspeakers as received at the ears are equal in amplitude and phase. When the head is turned, various other factors come into account. FIG. 1 of the accompanying drawings, taken from an article entitled "Measurement of Diffraction and Interaural Delay of a Progressive Sound Wave Caused by the Human Head" published by applicant and Messrs. Abbagnaro and Bauer in *J. Acoustical Society of America,* Vol. 58, No. 3, September 1975, illustrates the effect of the head on a single-sound wave front arriving at an angle of 90° from the front of the listener. At low frequencies, the sound to the far ear is delayed by approximately 0.8 milliseconds, and, furthermore, the head acting as a baffle, causes a rise in sound pressure at the near ear and a decrease in sound pressure at the far ear. As the left-right difference curve in FIG. 1 illustrates, the overall amplitude difference between the sound at the two ears in this case differs from 0 dB at low frequencies to approximately −15 dB at 10 kHz. Delays and pressure responses for other head orientations are of lesser magnitude, but still significant.

That listeners rely on interaural time difference cues in localization has long been recognized. In 1959, in an article entitled "A Compatible Stereophonic Sound System", *Bell Laboratories Record,* November 1959, F. K. Becker proposed a stereophonic matrix which used time-of-arrival information to vary the apparent location of images between two loudspeakers. Time differences at the ears were studied in detail by D. M. Leakey, resulting in a general localization theory based on phase differences at low frequencies and time differences between sound envelopes at higher frequencies; the results of this study are described in an article entitled "Some Measurements on the Effects of Interchannel Intensity and Time Differences in Two-Channel Sound Systems", *Journal of the Acoustical Society of America,* Vol. 31, No. 7, July 1959. While a panning function based on the above-mentioned criteria could be employed in a stereophonic mixing system, it is clear that such a function could be idealized only for listeners on the line of symmetry between the loudspeakers.

Other researchers have studied the effect of varying the amplitude between stereophonic loudspeakers to position phantom images. An article entitled "Phasor Analysis of Some Stereophonic Phenomena" published by B. B. Bauer in the *Journal of the Acoustical Society of America,* Vol. 33, No. 11, November 1961, describes the now famous "Stereophonic Law of Sines" which provided one of the first means to quantify such panning. Bauer derived the following relationship: $\text{Sin}\ \theta_I/\text{Sin}\ \theta_A=(S_L-S_R)/(S_L+S_R)$, approximately, where $\theta_I$ is the azmith angle of the virtual image, and A is the azmith angle of the real sources, and $S_L$ and $S_R$ are the strengths of the signals applied to the left and right loudspeakers, respectively. FIG. 2 illustrates the use of the "Law of Sines" for the case of two loudspeakers at an angle of 90° to the listener. Bauer's law is not completely accurate, since it applies only to low frequencies below 500 Hz and is constrained to the use of in-phase signals. While the slope of the curve shown in FIG. 2 has been questioned by some researchers, most confirm the endpoint of 20 dB separation required for a fully discrete image.

Given the apparent impossibility of satisfying the perceptual requirement for listeners at arbitrary locations in a room, it is not surprising that early practioners of stereophony characterized the center image problem as the "hole in the middle." Most early attempts at solving the problem involved the derivation of a sum signal (L+R) and applying it to a third loudspeaker located at the center. Such a "trifrontal" approach does indeed stabilize the center image, especially if the gain of the center channel is increased by 3 dB with respect to the left or right channels as recommended by Klipsch in his article "Three-Channel Stereo Playback of Two Tracks Derived From Three Microphones", *I.R.E. Trans. Audio,* Vol. 7, March–April 1959. However, this approach causes a dramatic shrinkage of the apparent width of the stereophonic stage; following Bauer's "Law of Sines" as illustrated in FIG. 3, the original 90° width would be reduced to 45° when the signal level, in all loudspeakers is equal. If the center channel gain is reduced by 3 dB, the maximum stage width will be increased to 73°, but of course at the expense of reduced stability of the center image. Later experimentation with quadraphonic matrices sometimes encoded the center-front image by separating the left and right components of this signal by 90°; less shifting of the center-front image occurs in such a display, probably because the image itself appears so wide as to be unacceptable for important music or dialogue.

One solution which appears to be quite satisfactory from the listener's point of view (hearing) is employed routinely in the cinema, in which important dialogue is usually assigned to a discrete center channel feeding a center-screen loudspeaker. While the method requires slightly more complex mixing and recording facilities, it is direct in its approach and provides satisfactory reproduction of important signals. Although the addition of a new loudspeaker interposed between the left and right loudspeakers provides the opportunity to pan additional virtual images at the near left and near right locations, for non-dialogue effects it appears quite satisfactory to simply pan from left to right, especially for rapidly moving or non-discrete effects. The three-channel technique provides a sensible solution which allows every member in a theatre audience to experience sound images at the proper location, and suggests the desirability of incorporating a discrete center-sound channel in television reproduction.

Among various proposals that have heretofore been advanced for three-channel FM stereo transmission systems, the one described in Halpern U.S. Pat. No. 3,679,832 is illustrative. In this system, three indepndent sources of stereophonically related audio frequency waves are added together to obtain a sum signal. Each audio frequency wave is also used to amplitude-modulate a respective subcarrier signal, the subcarrier signals being of the same frequency and spaced 120° apart in phase. A suppressed-carrier, double-sideband modulation of each subcarrier is employed, with the frequency of the subcarrier signals being sufficiently high as to assure a frequency gap between the lower sidebands of the modulated subcarrier signals and the sum signal. To achieve the desired compatibility with monophonic and two-channel stereophonic FM receivers, the amplitude of each double-sideband suppressed-carrier signal is multiplied by a factor of $2/\sqrt{3}$. A conventional low-level phase reference pilot signal, lying within the frequency gap, is employed for receiver detection purposes. A second pilot signal, of one-third the amplitude of the third harmonic of the phase reference pilot, is utilized to achieve three-channel receiver compatibility with a monophonic or two-channel stereophonic broadcast. The sum signal, the three double-sideband suppressed-carrier signals, and the two pilot signals are frequency modulated onto a high frequency FM carrier for transmission purposes.

The composite, frequency modulated, carrier signal is transmitted to one or more receivers, which may be either of the conventional monophonic or two-channel stereophonic type or preferably a three-channel stereo receiver, each adapted to receive and reproduce the three-channel broadcast in accordance with its respective mode of operation. Compatibility of the three-channel stereophonic receiver with one-channel or two-channel broadcast is achieved by the use of the second pilot signal. In the absence of this pilot, the three-channel receiver operates in a conventional manner to reproduce a monophonic or two-channel stereophonic broadcast. The second pilot signal is used as an indicator for a three-channel broadcast and when the same is received by a three-channel receiver it serves to switch the latter into a three-channel stereophonic reception mode. Thus, a three-channel broadcast is compatible with a one, two, or three-channel receiver, while the three-channel receiver is compatible with a one, two, or three-channel broadcast.

This system is relatively complex in that it requires two pilot signals and a phase-shift network for establishing the 120° phase relationship between the subcarrier signals, and has the disadvantage that all three of the independent source signals are modulated to enable recovery of third-channel information, some of which information gets into the output of a two-channel receiver.

SUMMARY OF THE INVENTION

It is a primary object of the present invention to provide a triphonic transmission system that is fully compatible with existing monophonic receivers and with new television receivers that may employ only two loudspeakers.

A related object of the invention is to provide a triphonic transmission system that will provide center-channel quality equivalent in all respects to that of the left and right channels without significant degradation or compromise of existing monophonic or future biphonic service and coverage.

In accordance with the present invention, three independent sources of stereophonically ralated audio frequency waves characterized as L(left), R(right) and C(center), are matrixed to obtain three signals exhibiting the matrix equations: (1)$M=L+1.4C+R$; (2)$S=L-R$; and (3)$T=-1.4C$. Each of audio frequency waves S and T is used to amplitude-modulate a respective subcarrier signal, the subcarrier signals being of the same frequency and spaced 90° apart in phase. Suppressed-carrier, double-sideband modulation of each subcarrier is employed, with the frequency of the subcarrier signals being sufficiently high as to assure a frequency gap below the lower sidebands of the modulated subcarrier signals and the M signal. A conventional low-level phase reference pilot signal, lying within the aforementioned frequency gap, is employed for receiver detection purposes. The aforementioned M signal, the two double-sideband suppressed-carrier signals, and the pilot signal are frequency modulated onto a high frequency FM carrier for transmission purposes.

The composite, frequency modulated, carrier signal is transmitted to one or more remote receivers, which may be of the conventional monophonic or two-channel stereophonic type, or preferably a triphonic receiver constructed in accordance with the invention. Typically, a plurality of receivers of each type will receive and reproduce the three signals, each in accordance with its respective mode of operation. A conventional monophonic receiver decodes only the sum signal (M), and a two-channel receiver reproduces the transmitted M signal in both loudspeakers for monophonic reception, and the traditional stereophonic signals for the biphonic and triphonic modes. For a third category of receiver having a large screen and three widely-spaced loudspeakers, a choice of reproduction is available. For reproduction of monophonic transmissions, the sum signal (M) can be utilized in all three loudspeakers, although at reduced level in the flanking loudspeakers so as to avoid "pulling" the sound image away from its desirable center location. For biphonic broadcasts, the M signal may be used for the center loudspeaker, and the conventional left and right signals for the flanking loudspeakers. Finally, the reproduction of triphonic broadcasts results in the display of left, center, and right signals by respective loudspeakers; in this case, the signal T is fed directly to the center loudspeaker, and is also used to electrically subtract the center signal components from the left and right channels, resulting in fully discrete performance.

BRIEF DESCRIPTION OF THE DRAWINGS

The invention will be more fully appreciated from the following detailed description when considered in connection with the accompanying drawings in which.

DETAILED DESCRIPTION

Figure 1:
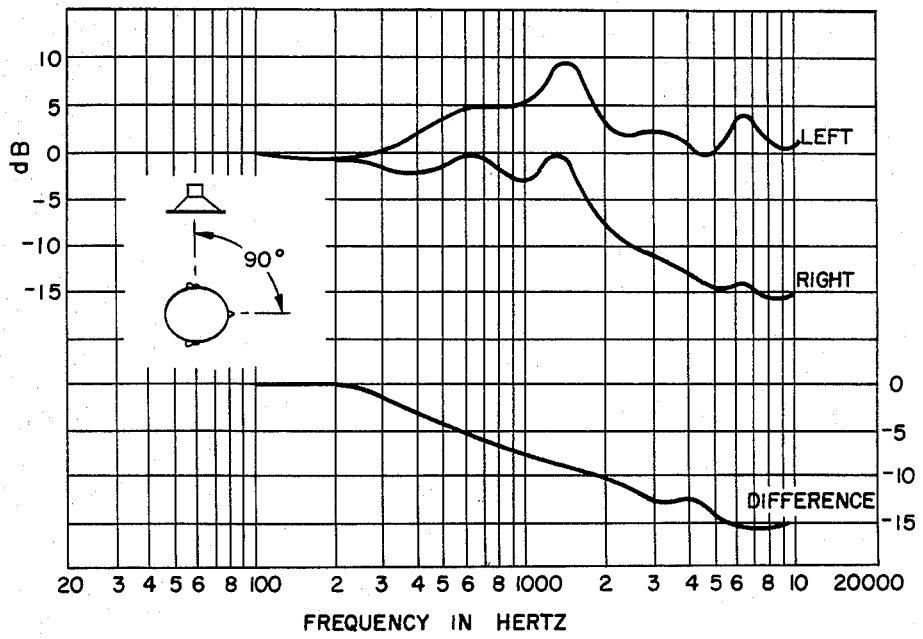
FIG. 1, to which reference has already been made, is a plot illustrating the effect of the head on a single-sound wave front arriving at an angle of 90° from the front of the listener.
Figure 2:
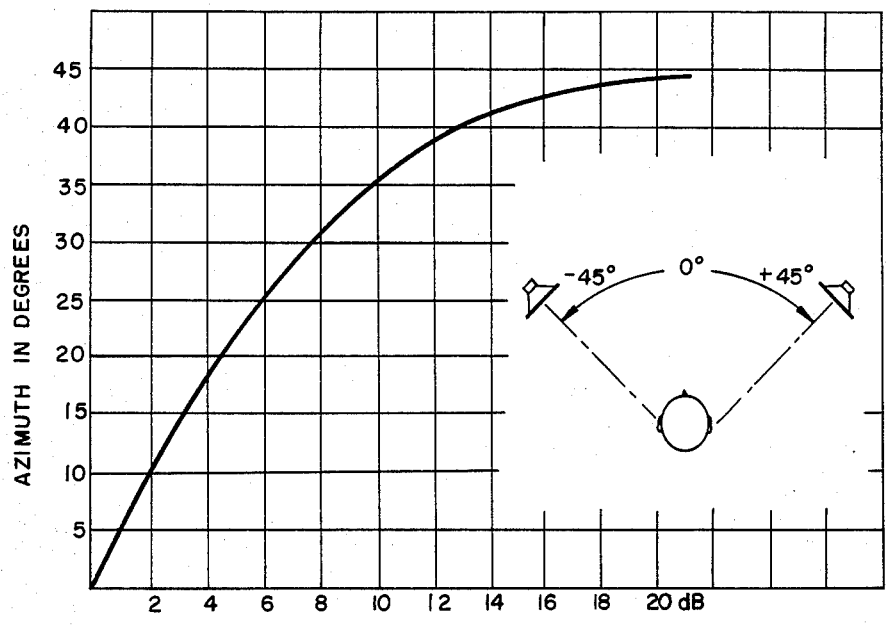
FIG. 2, to which previous reference has been made, is a plot showing the use of the "Law of Sines" for the case of two loudspeakers at an angle of 90° to the listener.
Figure 3:
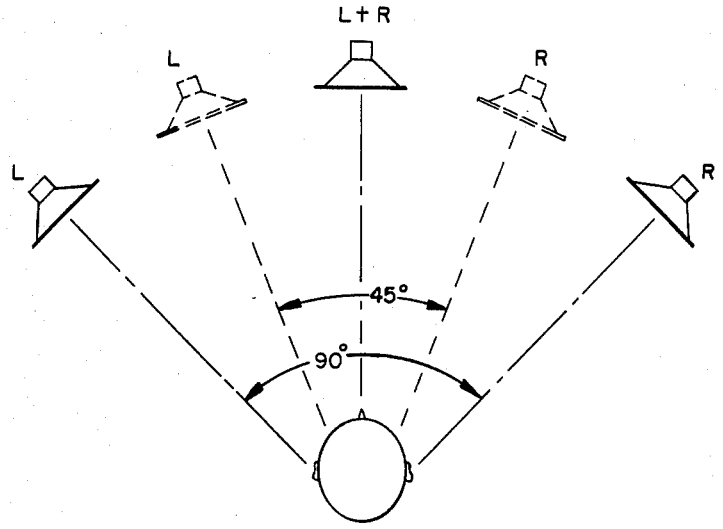
FIG. 3, previously referred to, illustrates an application of the "Law of Sines"

Before describing the present invention, it may be useful to briefly review the basic principles of the existing two-channel stereo system approved by the FCC, as well as multi-channel television sound systems presently under consideration for future broadcast service in the United States. In the current radio system, the stereophonically related signals that are added together constitute a "monophonic channel" which consists of a (L+R) signal of 50 to 15,000 Hz, where L and R represent the left and right independent audio signals or channels; as noted earlier, each of the L and R signals may also include a 0.7C component. It is this combined signal that is reproduced by a standard monaural FM receiver, hence the descriptive term "monophonic channel" and the use herein of the letter M to identify this channel. To this is added a double-sideband suppressed 38 kHz subcarrier signal S sin $\omega_s t$, where S=(L−R), along with a pilot of 19 kHz. The composite modulation signal can be written as:

$$e_m = M + S \sin \omega_s t + p \sin (\omega_s t/2)$$

where $\omega_s = 2\pi f_s$ and $f_s = 38$ kHz, and p is the amplitude of the 19 kHz pilot. Looking at the baseband spectrum, one would find a monophonic channel M from about 50 Hz to 15 kHz, a 19 kHz pilot, and a sterephonic channel S sin $\omega_s t$ signal from 23 to 53 kHz. If SCA (Subsidiary Communication Authorization) is also being transmitted, there is an SCA frequency modulated subcarrier band from 59.5 to 74.5 kHz.

Three multi-channel television sound systems are presently under consideration for future broadcast service in the United States. These three systems are described in some detail in a July 1982 Electronics Industries Association report entitled "Multi-channel Television Sound: The Basis for Selection of a Single Standard", but suffice it to say for present purposes that all three propose the transmission of a stereophonic subcarrier for two-channel audio programming, a second audio program (SAP) for additional language or other service, and a third subcarrier for non-public telemetry or electronic news gathering (ENG) use. All subcarriers are located at frequencies which are integer or fractional multiples of the NTSC television horizontal synchronization frequency ($f_H$=15,743 Hz). A system proposed by the Electronic Industries Association of Japan utilizes frequency modulation of the stereophonic subcarrier, while the other two, proposed by Telesonics and Zenith, respectively, utilize double-sideband suppressed carrier amplitude modulation, similar to that employed in standard FM stereophonic radio broadcasts.

As has been noted earlier, in the present system in independent third or triphonic signal T is provided for reproduction by a center loudspeaker and also to be used to electrically subtract the center signal components from the left and right channels to give a fully discrete performance. There are two choices, in the three proposed multi-channel television sound systems, for the potential location of this new triphonic signal, T. Any of the three systems could accommodate the signal T in the SAP channel, although with varying degrees of audio fidelity. The two systems which use an amplitude modulated stereophonic subcarrier provide an alternate means for transmission of the T signal, in that in either one the new signal T can be incorporated as quadrature modulation of the same suppressed carrier that carries the stereophonic difference signal $S=(L-R)$. The triphonic system of the present invention will be described in the context of the Telesonics and Zenith multi-channel television sound systems which differ, for present purposes, only in the frequency of its stereophonic pilot tone, which is $f_H$ for the Zenith system and $5/4f_H$ for the Telesonics system.

Figure 4:
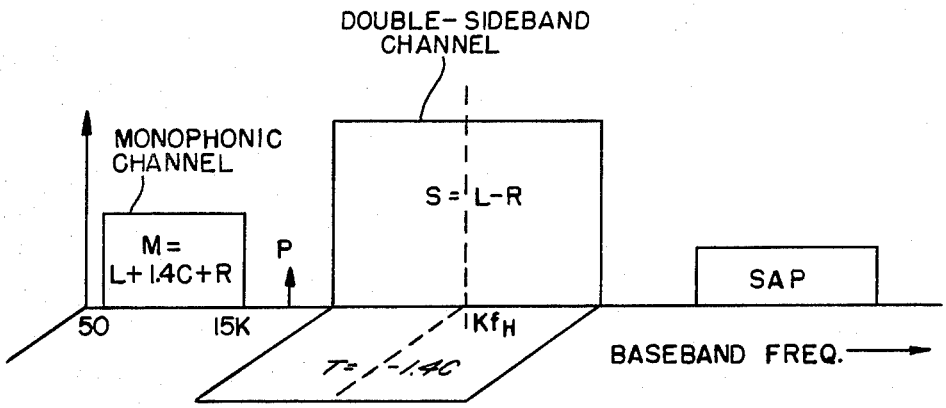
FIG. 4 is a frequency diagram of the composite baseband signal developed in accordance with the principles of the present invention.

In the triphonic sound system of the present invention, to the monophonic channel are added two double-sideband $kf_H$ kHz signals (where k is 2.0 or 2.5), one corresponding to a difference signal consisting of (L−R) and the other consisting of a signal (T=−1.4C) and spaced 90° apart in phase, along with a pilot signal having a frequency of either $f_H$ or $5/4f_H$ (for the Zenith and Telesonics systems, respectively) all as shown in FIG. 4. In accordance with the Zenith and Telesonics design specifications, the amplitude of each of the double-sideband signals is twice the amplitude of the monophonic channel signal, and the pilot, in turn, has a somewhat smaller amplitude. Thus, the composite baseband signal of this triphonic sound system can be written as follows:

$$e_m = (L + 1.4C + R) + p \sin \omega t + (L - R) \sin 2\omega t + (-1.4C) \cos 2\omega t \quad \text{(Equation 1)}$$

where L, R and C are independent audio channels, $\omega = 2\pi k f_H$ ($f_H$=15.734 kHz and k=2.0 or 2.5) and p is the amplitude of the pilot signal.

Figure 5:
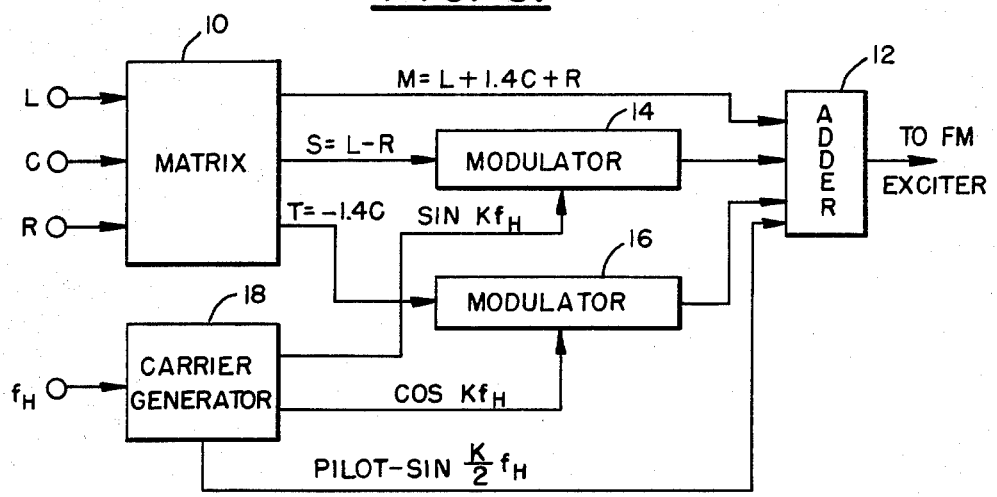
FIG. 5 is a simplified block diagram of a transmitting terminal for generating the composite signal of FIG. 4.

The transmitter for generating this composite signal is illustrated in the block diagram of FIG. 5. For purposes of simplicity, some of the more conventional transmitter circuits (e.g., pre-emphasis networks, carrier frequency source, and carrier frequency modulator) have not been shown and will be mentioned only briefly, where necessary, in the following description. The three audio frequency signals L, C, and R, derived from three independent sources (not shown), are applied by preemphasis networks (not shown) to the inputs of a conventional matrix network 10 consisting, for example, of a network of summing amplifiers arranged to produce at the output of the matrix three audio signals as follows: (1) (L+1.4C+R), (L−R), and (−1.4C). The monophonic signal (M) is applied as one input to an adder 12, and the stereophonic difference signal (L−R) and the triphonic signal (−1.4C) are applied to the inputs of respective modulators 14 and 16, the outputs of which are also delivered to adder 12 where they are linearly combined with the monophonic signal.

The subcarrier and pilot signal are derived from a carrier generator 18, which is synchronized with and clocked by a signal $f_H$ (the television horizontal synchronization frequency) derived from the video signal to be transmitted along with the audio signals, and which is designed to provide an output sinewave signal S having a frequency of $kf_H$ kHz, where, again, k is either 2.0 or 2.5, depending upon whether the Zenith or Telesonics system is used. The carrier generator includes any one of the known arrangements for providing a 90° phase displacement between the subcarrier output signals applied to the respective modulators, as indicated in FIG. 5. The modulators 14 and 16 comprise suppressed-carrier amplitude modulators of known construction which serve to amplitude-modulater the two subcarriers with respective audio frequency signals so as to produce the two double-sideband, suppressed-carrier, amplitude-modulated subcarrier signals (L−R) sin $2\omega t$ and (−1.4C) cos $2\omega t$. These latter signals are then combined in adder 12 with the monophonic signal M and a sinewave pilot signal of frequency k/2 $f_H$ derived from carrier generator 18. The composite signal produced at the output of adder 12, set forth in Equation 1 above, is then applied to the FM exciter of the transmitter (not shown) and frequency modulated onto a high frequency FM carrier for transmission purposes.

Figure 6:
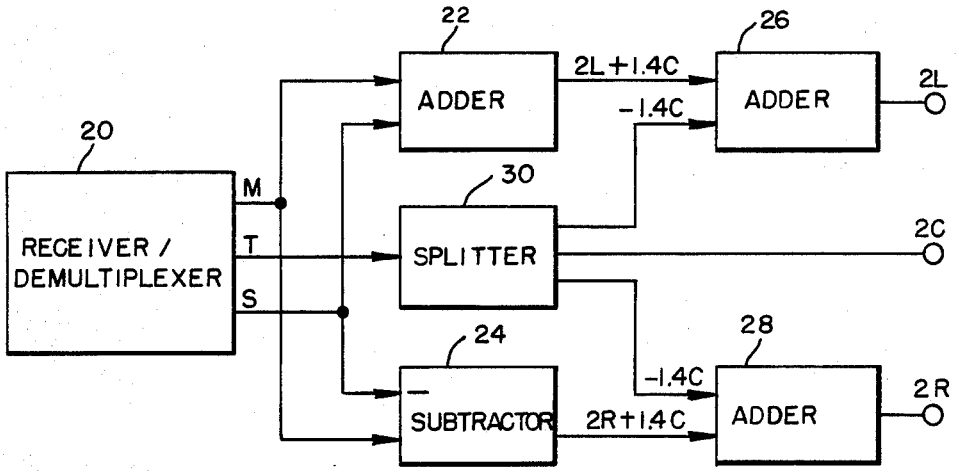
FIG. 6 is a simplified block diagram of a receiving terminal in accordance with the invention.

A triphonic receiver, in accordance with the invention, is shown in the block diagram of FIG. 6 and, again, for purposes of simplicity, some of the more conventional FM receiver circuits (e.g., RF and IF stages, discriminator, and de-emphasis networks) have not been shown and will be only briefly mentioned as necessary. In addition to reproducing a triphonic broadcast, in the manner to be described, the receiver is fully compatible with conventional monophonic and two-channel (biphonic) stereophonic broadcasts. A received FM signal is amplified in the RF and IF stages (not shown) of a receiver/demultiplexer 20, and demodulated in any of the known FM detection circuits (not shown) and demultiplexed to derive the audio signals contained in the received FM signal.

When a monaural broadcast is being received, the output of the demultiplexer comprises the monaural signal M consisting of (L+1.4C+R). This signal is applied as a first input to both an adder 22 and a subtractor 24, the outputs of which are applied to a first input of an adder 26 and an adder 28, respectively. In the absence of signals applied to the second inputs of subtractor 24 and adders 22, 26, and 28, the monophonic M signal (i.e., [L+1.4C+R]) appears at the output of each of adders 26 and 28, one of which may be selected by suitable switching (not shown) for reproduction.

For a received two-channel stereo signal, the M and S signals will be derived at the output of the demultiplexer; as before, the M signal is applied to one input of each of adder 22 and subtractor 24, and the S signal (L−R) is applied as a second input to adder 22 and is subtracted from the signal M in subtractor 24. As a result, the output of adder 22 comprises the signal (2L+1.4C), and absent a signal at the second input of adder 26, the output of adder 26 will be (2L+1.4C), the amplitude of which is then reduced by one-half to obtain a signal (L+0.7C) for application to the left loudspeaker. Similarly, subtraction of the difference signal (L−R) from the monophonic signal yields a signal (2R+1.4C), and since this signal likewise is not modified by adder 28, it appears at the output of adder 28; again, reducing the amplitude of this signal by one-half yields the signal (R+0.7C) for reproduction by the right loudspeaker of the two-channel system. All of the above is typical of the mode of operation of a conventional two-channel FM receiver.

For a received triphonic signal, that is, a composite signal including the new T signal (−1.4C), the M, S, and T signals all appear at the output of demultiplexer 20; the M and S signals are applied to adder 22 and subtractor 24 as before, and the T signal is applied to a splitter circuit 30, a known matrix network designed to pass the (−1.4C) signal through to two separate outputs for application to the second input of each of adders 26 and 28, and to alter the amplitude of the T signal and deliver to a third output terminal the signal 2C which, after suitable reduction in amplitude, is fed directly to the center loudspeaker of a triphonic reproduction system. The linear addition in adder 26 of the signals (2L+1.4C) and (−1.4C) yields a signal 2L and, similarly, the addition in adder 28 of the signals (2R+1.4C) and (−1.4C) yields the discrete signal 2R; thus, after suitable reduction in amplitude, discrete L and R signals are available for application to the left and right loudspeakers, respectively, of the triphonic sound reproduction system.

Figure 7:
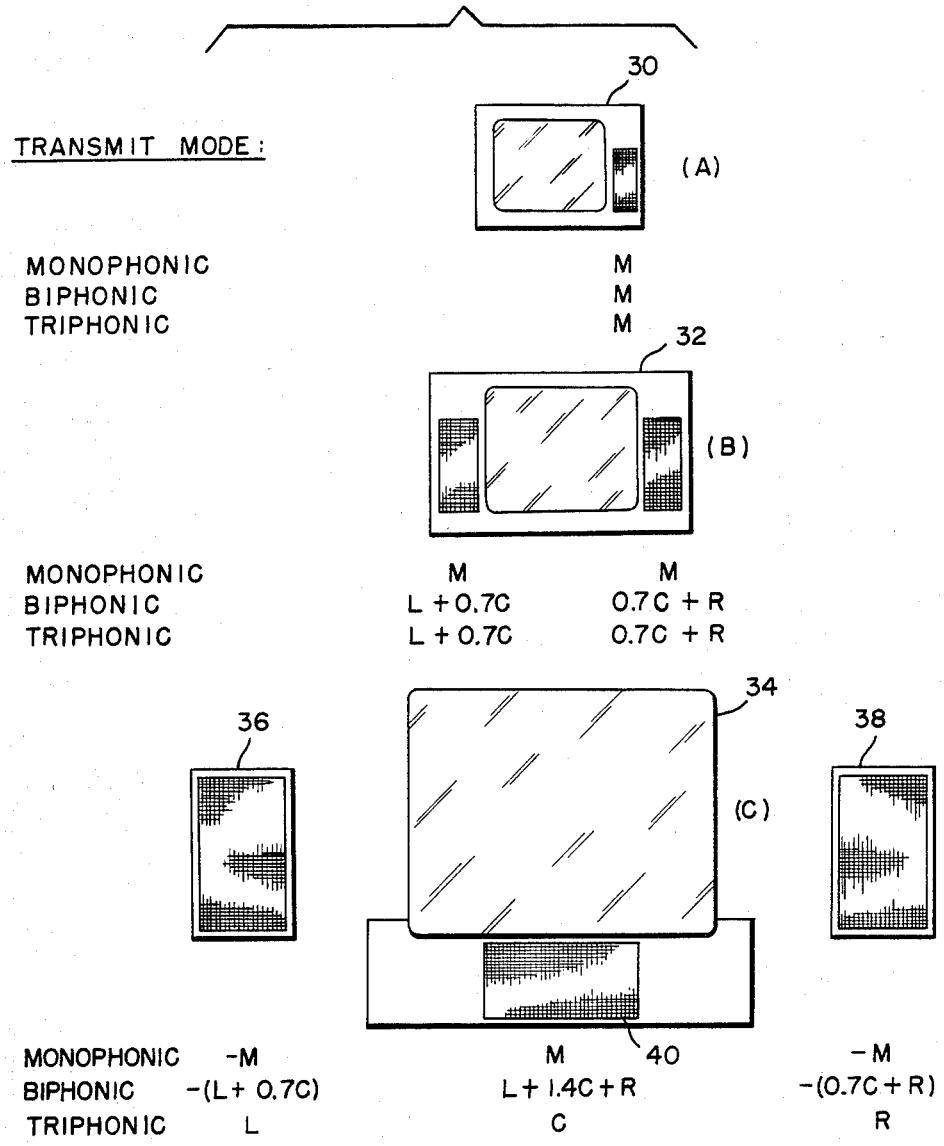
FIG. 7 is a pictorial diagram illustrating the reception mode hierarchy in accordance with the principles of the invention.

The reception mode hierarchy described above is seen in FIG. 7 which shows the three types of television receivers in which the three different transmit modes would be encountered, namely, a current conventional television set 30 having a single loudspeaker, a biphonic receiver 32 equipped with two loudspeakers for stereophonic reproduction of television sound, and a system likely to have future prominance having a large screen display 34, a pair of outboard left and right loudspeakers 36 and 38, and a center loudspeaker 40 positioned centrally of and below the viewing screen. In the first case, as explained above, regardless of whether the transmission is monophonic, biphonic, or triphonic in accordance with the present invention, the monaural M signal is reproduced by the single loudspeaker. The two-channel reproduction capability of receiver 32 displays the monaural signal M on each of its loudspeakers when the transmission is monophonic, and for both biphonic and triphonic transmissions displays the signal (L+0.7C) on its left loudspeaker and the signal (R+0.7C) on its right loudspeaker. Finally, for the receiver having a large screen and three loudspeakers, the audio designer has a number of choices. For reproduction of monophonic transmissions, it is possible to utilize the M signal in all three loudspeakers, although at reduced level in the flanking loud speakers 36 and 28 so as to avoid "pulling" the sound image away from its desirable center location. Employing these flanking loudspeakers in the illustrated out-of-phase condition, may add somewhat to a feeling of increased ambience. For biphonic broadcasts, the M signal may be used for the center loudspeaker, and the conventional left and right signals for the flanking loud speakers; here, too, an out-of-phase presentation may minimize slightly the impression of a shrunken stage width. Finally, for triphonic broadcasts, the discrete L and R signals are applied to a respective flanking loudspeaker and the discrete C signal is fed directly to the center loudspeaker to provide accurate display of the three signals, comparable to that obtained in cinema sound systems.

Desirably the system according to the invention includes an identification signal to permit automatic switching of receivers to the triphonic reception mode. Such a signal can be incorporated in the video signal or within the audio baseband spectrum. One of at least two possibilities is to use a second pilot signal utilizing one-third amplitude of the third harmonic of the main pilot as suggested by Halpern in the aforementioned U.S. Pat. No. 3,679,832, which does not increase the instantaneous frequency deviation of the FM carrier. Alternatively, depending on the baseband configuration selected, it may be preferable to employ amplitude modulation of the first pilot; a subharmonic frequency of the pilot should be selected to provide sidebands far enough beyond the capture range of receiver pilot detectors, yet low enough in frequency that the resultant sidebands about the pilot do not fall within the main or stereophonic channels.

It will have become apparent from the foregoing that the distinctive requirements for satisfactory multichannel sound reproduction in television make it desirable to extend the scope of the sound systems currently being considered for broadcast service. Although the unstable center sound image does not present a severe handicap in the reproduction of sound without pictures, this is not the case in television, particularly those with wide-screen displays and widely spaced loudspeakers; such systems demand a stable center sound, clearly suggesting that new television audio service must follow the example of the cinema rather than that of audio recording or FM radio broadcasting. The described triphonic system according to the present invention addresses and satisfies this need in that it is easily transmitted, with little or no penalty in station modulation capability or area of broadcast coverage. The system offers the potential for minimizing program production and editing costs, since the major portion of sound-track program will undoubtedly continue to be center-channel dialogue. Finally, since the triphonic system is hierarchical, it offers broadcasters and receiver manufacturers alike an unusual opportunity for flexibility in selection of operational modes.

The foregoing disclosure is intended to be merely illustrative of the principles of the present invention and numerous modifications or alterations might be made therein without departing from the spirit and scope of the invention. For example, although the T signal is described as having a value of −1.4C, it is obvious that the value may be +1.4C, which would require that adders 26 and 28 instead be subtracting circuits to obtain the same results.

I claim:

1. In a triphonic sound transmission system, a transmitter comprising:

means for combining three independent stereophonically related audio frequency source waves L, R and C to obtain three audio frequency signals M, S and T respectively comprising (L+1.4C+R), (L−R) and (−1.4C);

means for generating two subcarriers of the same frequency and spaced 90° apart in phase;

means for amplitude-modulating each subcarrier with a respective one of said audio frequency signals S and T to develop two double-sideband suppressed-carrier signals, the frequency of said subcarriers being sufficiently high as to assure a frequency gap between the lower sidebands of the modulated subcarrier signals and the said M signal;

means for generating a phase reference pilot signal having a frequency which is one-half the frequency of the subcarriers and lies within said frequency gap; and means for frequency modulating the aforementioned signals onto a high frequency carrier for the purpose of transmitting the same to one or more remote receivers.

2. A triphonic system as defined in claim 1 including receiver means operative in response to the reception of said high frequency carrier to reproduce each of the audio frequency source signals L, R and C.

3. A triphonic system as defined in claim 2 wherein said receiver means includes means for reproducing conventional monophonic and two-channel stereophonic broadcasts.

4. A triphonic sound system comprising:

a transmitter including means for combining three independent stereophonically related audio frequency source signals L, C, and R to obtain three audio frequency signals M, S and T respectively comprising (L+1.4C+R), (L−R) and (−1.4C), means for amplitude-modulating each of two equal frequency quadrature-phased subcarriers with a respective one of said audio frequency signals S and T, and means for frequency modulating the aforementioned signals onto a high frequency carrier for the purpose of transmitting the same to one or more remote receivers; and receiver means operative in response to the reception of said frequency-modulated carrier for reproducing each of said audio frequency source signals.

5. A triphonic sound system as defined in claim 4, wherein said carrier is modulated in accordance with the modulation function $$e_m = M + p \sin(\omega_s t/2) + S \sin \omega_s t + T \cos \omega_s t$$

where p is the amplitude of a phase reference pilot signal $\sin(\omega_s t/2)$, and $\omega_s = 2\pi f_s$, where $f_s$ is the fundamental frequency of the subcarrier signals $\sin \omega_s t$ and $\cos \omega_s t$, each subcarrier signal being suppressed-carrier double-sideband amplitude-modulated by a respective one of said audio frequency signals S and T.

6. A triphonic sound system as defined in claim 5, wherein $f_s = kf_H$, k is a constant, and $f_H = 15{,}734$ Hz, the horizontal synchronization frequency for NTSC television.

7. A triphonic sound system as defined in claim 3, wherein the constant k is selected from 2.0 or 2.5.

8. A triphonic sound system as defined in claim 4, wherein said receiver means includes means for alternatively reproducing conventional monophonic and two-channel stereophonic broadcasts.

9. A triphonic sound system as defined in claim 8, wherein said receiver means includes first and second means for combining said audio signals M and S to obtain first and second intermediate audio signals (2L+1.4C) and (2R+1.4C), respectively, and third and fourth means for combining said first and second intermediate audio signals, respectively, with said audio signal T to obtain said audio frequency source signals L and R.

10. In a triphonic sound transmission system, a transmitter comprising:

means for combining three independent stereophonically related audio frequency source signals L, C, and R to obtain three audio frequency signals M, S and T respectively comprising (L+1.4C+R), (L−R) and (−1.4C), means for modulating each of two subcarriers with a respective one of said audio frequency signals S and T, and means for frequency modulating the aforementioned signals onto a high frequency carrier for the purpose of transmitting the same to one or more remote receivers.

11. A transmitter as defined in claim 10, wherein a first of said subcarriers is modulated by said audio frequency signal S and has a frequency which assures a frequency gap between the lower sideband of the modulated subcarrier signal and the M signal, and wherein the second of said subcarriers is modulated by said audio frequency signal T and has a frequency higher than the frequency of said first subcarrier.

12. A transmitter as defined in claim 10, wherein said subcarriers are quadrature-phased and of the same frequency, which frequency is sufficiently high as to assure a frequency gap between the lower sidebands of the modulated subcarrier signals and the said M signal.

13. A receiver for use in a triphonic sound system having a transmitter including means for combining three independent stereophonically related audio frequency source signals L, C, and R to obtain three audio frequency signals M, S and T respectively comprising (L+1.4C+R), (L−R) and (−1.4C), means for modulating each of two subcarriers with a respective one of said audio frequency signals S and T, and means for frequency modulating the aforementioned signals onto a high frequency carrier for the purpose of transmitting the same to one or more remote receivers, said receiver comprising:

means operative in response to reception of said high frequency carrier for deriving said audio frequency signals M, S and T, and means for combining said M, S and T signals to reproduce each of the audio frequency source signals L, R and C.

14. A receiver as defined in claim 13, wherein said combining means includes first and second means for combining said audio signals M and S to obtain first and second intermediate audio signals (2L+1.4C) and (2R+1.4C), respectively, and third and fourth means for combining said first and second intermediate audio signals, respectively, with said audio signal T to obtain said audio frequency source signals L and R.

15. A receiver as defined in claim 13, wherein said receiver includes means for alternatively reproducing conventional monophonic and two-channel stereophonic broadcasts.

16. A receiver as defined in claim 13, wherein said combining means is operative to alternatively reproduce received conventional monophonic and two-channel stereophonic broadcasts.

17. In a triphonic sound system, a receiver for demodulating a high frequency carrier signal frequency modulated by first and second subcarriers respectively modulated by audio frequency signals S and T and by an audio frequency signal M, where the signals M, S and T comprise combinations of three independent stereophonically related audio frequency source signals, R, and C, said combinations comprising (L+1.4C+R), (L−R) and (−1.4C), respectively, said receiver comprising:

means operative in response to said high frequency carrier for deriving said audio frequency signals M, S and T, means for combining said audio signals M and S to obtain first and second intermediate audio signals (2L+1.4C) and (2R+1.4C), respectively, means for deriving said audio signal T, and means for separately combining said audio signal T with each of said intermediate audio signals to obtain said audio frequency source signals L and R.

* * * * *